US007064715B2

(12) United States Patent
Wu et al.

(10) Patent No.: US 7,064,715 B2
(45) Date of Patent: Jun. 20, 2006

(54) ANTENNA MODULE FOR AN ELECTRONIC APPARATUS

(75) Inventors: Chien-Yi Wu, Kaohsiung (TW); Chi-Yin Fang, Ping-Tung (TW)

(73) Assignee: Quanta Computer Inc., Tao-Yuan Hsien (TW)

( * ) Notice: Subject to any disclaimer, the term of this patent is extended or adjusted under 35 U.S.C. 154(b) by 0 days.

(21) Appl. No.: 11/088,804

(22) Filed: Mar. 25, 2005

(65) Prior Publication Data

US 2005/0248490 A1 Nov. 10, 2005

(30) Foreign Application Priority Data

May 5, 2004 (TW) ..... 93112603 A

(51) Int. Cl.
*H01Q 1/38* (2006.01)

(52) U.S. Cl. ..... 343/700 MS

(58) Field of Classification Search ..... 343/700 MS, 343/702, 795, 895
See application file for complete search history.

(56) References Cited

U.S. PATENT DOCUMENTS 6,642,893 B1 * 11/2003 Hebron et al. ..... 343/702
6,801,168 B1 * 10/2004 Yeh ..... 343/700 MS
6,809,689 B1 * 10/2004 Chen ..... 343/700 MS
6,870,506 B1 * 3/2005 Chen et al. ..... 343/700 MS
6,956,530 B1 * 10/2005 Kadambi et al. ..... 343/702

* cited by examiner

*Primary Examiner*—Don Wong
*Assistant Examiner*—Huedung X. Cao
(74) *Attorney, Agent, or Firm*—Davidson Berouist Jackson & Gowdey, LLP

(57) ABSTRACT

A multi-frequency antenna module includes first and second radiating elements disposed on a dielectric substrate and spaced apart from each other. A first conductor sheet of the first radiating element has a first signal-feeding contact and a grounding contact that contact electrically and respectively first and third electrical contacts on a circuit board of an electronic apparatus when the substrate is mounted in mounted in a housing of the electronic apparatus. A second conductor sheet of the second radiating element has a second signal-feeding contact that contacts electrically a second electrical contact on the circuit board when the substrate is mounted in the housing.

12 Claims, 6 Drawing Sheets

ANTENNA MODULE FOR AN ELECTRONIC APPARATUS

CROSS-REFERENCE TO RELATED APPLICATION

This application claims priority of Taiwanese Application No. 093112603, filed on May 5, 2004.

BACKGROUND OF THE INVENTION

1. Field of the Invention

The invention relates to an antenna module, more particularly to a concealed antenna module for an electronic apparatus.

2. Description of the Related Art

A conventional concealed-type planar inverted F (PIFA) antenna is widely applied to a variety of electronic apparatuses, such as mobile telephones. In actual applications, when the conventional PIFA antenna is applied to a mobile telephone with a reduced size, bandwidth requirements for a high frequency band, such as 1800 MHz and 1900 MHz, are not satisfied. For solving the above problem, an additional parasitic element is applied to the conventional PIFA antenna to increase the bandwidth for a high frequency band. However, the application of the parasitic element results in an increased size for the conventional PIFA antenna, and does not improve the bandwidth for a low frequency band.

SUMMARY OF THE INVENTION

Therefore, the object of the present invention is to provide an antenna module for an electronic apparatus that can eliminate the aforesaid drawbacks of the prior art.

According to one aspect of the present invention, there is provided a multi-frequency antenna module for an electronic apparatus. The electronic apparatus includes a housing, and a circuit board disposed in the housing and provided with first, second and third electrical contacts thereon. The multi-frequency antenna module comprises:

- a dielectric substrate adapted to be mounted in the housing and having a mounting surface;
- a first radiating element disposed on the mounting surface of the substrate and including a first conductor sheet that has a first signal-feeding contact adapted to contact electrically the first electrical contact on the circuit board when the substrate is mounted in the housing, and a grounding contact adapted to contact electrically the third electrical contact on the circuit board when the substrate is mounted in the housing; and
- a second radiating element disposed on the mounting surface of the substrate, spaced apart from the first radiating element, and including a second conductor sheet that has a second signal-feeding contact adapted to contact electrically the second electrical contact on the circuit board when the substrate is mounted in the housing.

According to another aspect of the present invention, there is provided an antenna module for an electronic apparatus. The electronic apparatus includes a housing, and a circuit board disposed in the housing and provided with first and second electrical contacts thereon. The antenna module comprises:

- a dielectric substrate adapted to be mounted in the housing and having a mounting surface; and
- a radiating element disposed on the mounting surface of the substrate and including a conductor sheet that has a signal-feeding contact adapted to contact electrically the first electrical contact on the circuit board when the substrate is mounted in the housing, and a grounding contact adapted to contact electrically the second electrical contact on the circuit board when the substrate is mounted in the housing.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
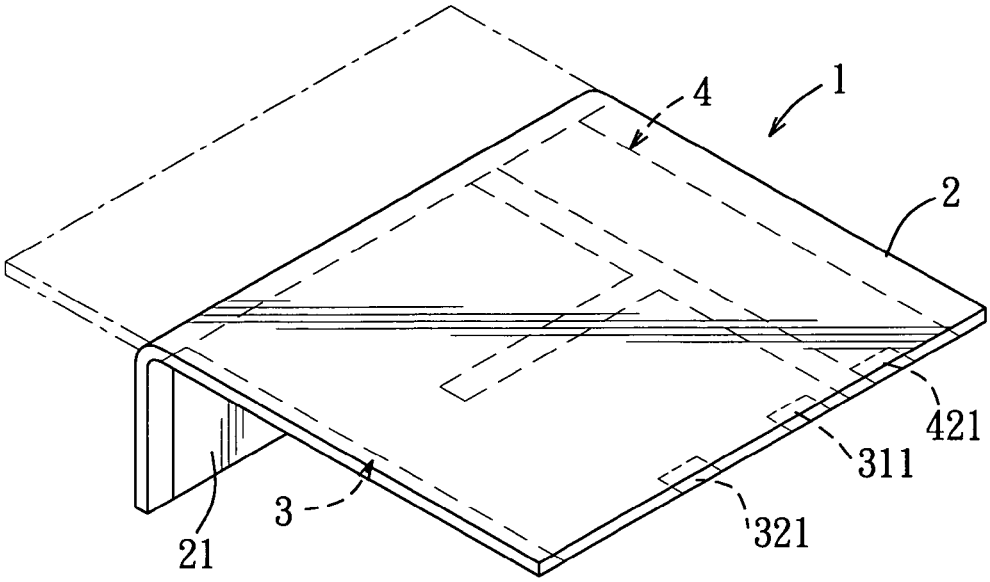
FIG. 1 is a perspective view showing the first preferred embodiment of a multi-frequency antenna module for an electronic apparatus according to the present invention.

Before the present invention is described in greater detail, it should be noted that like elements are denoted by the same reference numerals throughout the disclosure.

Figure 2:
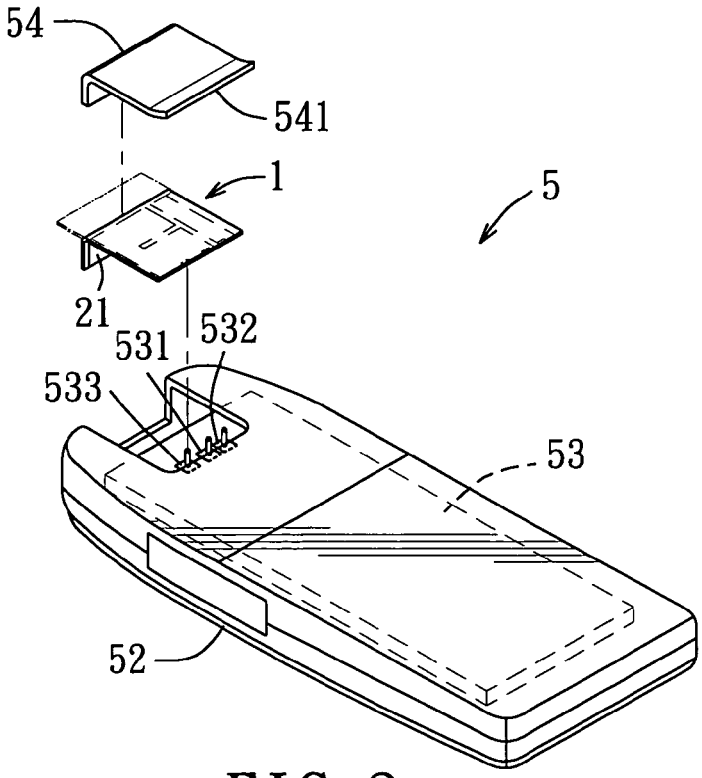
FIG. 2 is an exploded perspective view showing a portable electronic apparatus installed with the first preferred embodiment.
Figure 3:
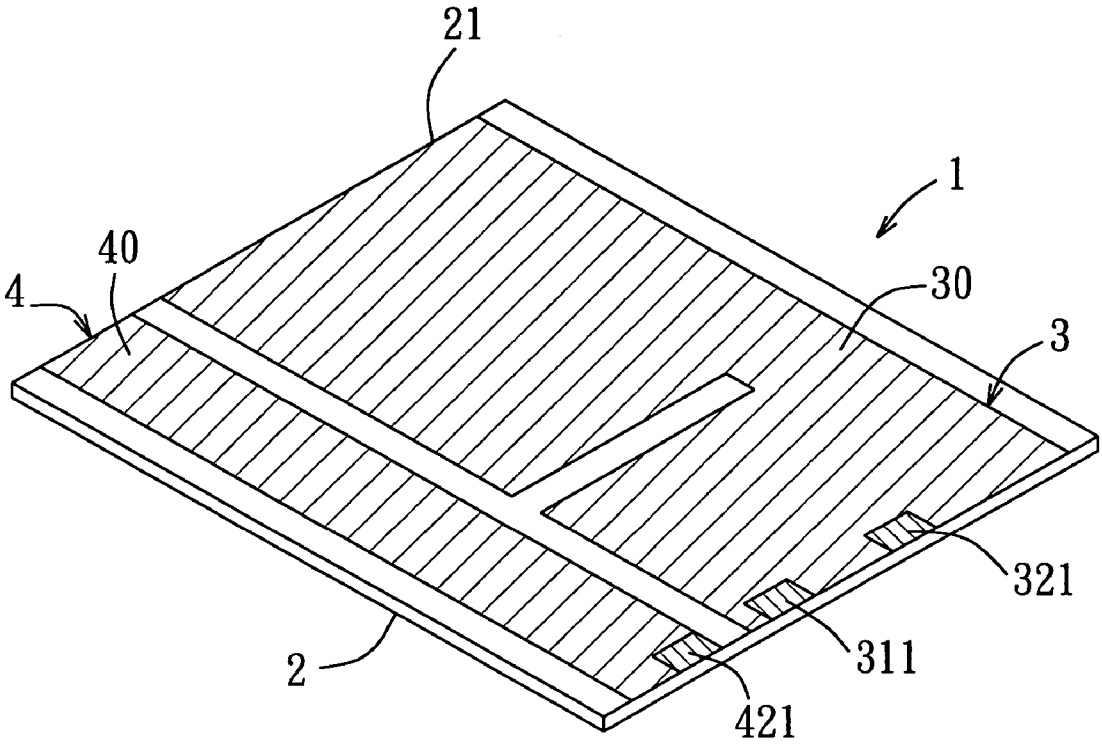
FIG. 3 illustrates the first preferred embodiment when viewed from another side.

FIGS. 1 to 3 illustrate the first preferred embodiment of a multi-frequency antenna module 1 for an electronic apparatus according to the present invention. In this embodiment, the electronic apparatus is a mobile telephone 5 that includes a housing 52, and a circuit board 53 disposed in the housing 52 and provided with first, second and third electrical contacts 531, 532, 533 thereon, each of which is a spring-loaded electrical contact. The housing 52 is formed with an opening and a cover plate 54 for covering the opening, as shown in FIG. 2. Referring to FIG. 3, the multi-frequency antenna module 1 is shown to include a dielectric substrate 2, a first radiating element 3, and a second radiating element 4.

The substrate 2, which is a flexible printed circuit board, is adapted to be mounted in the housing 52 and has a mounting surface 21. In this embodiment, the substrate 2 can be flexed so as to have a contour that corresponds to the inner surface 541 of the cover plate 54.

The first radiating element 3, which is capable of receiving and transmitting signals in a first frequency band, such as a 900 MHz (GSM) frequency band, is disposed on the mounting surface 21 of the substrate 2, and includes a first conductor sheet 30, which is substantially C-shaped in this embodiment, that has a first signal-feeding contact 311 adapted to contact electrically the first electrical contact 531 on the circuit board 53 when the substrate 2 is mounted in the housing 52, and a grounding contact 321 adapted to contact electrically the third electrical contact 533 on the circuit board 53 when the substrate 2 is mounted in the housing 52.

The second radiating element 4, which is capable of receiving and transmitting signals in a second frequency band different from and higher than the first frequency band, such as a 1800/1900 MHz (DCS/PCS) frequency band, is disposed on the mounting surface 21 of the substrate 2, is spaced apart from the first radiating element 3, and includes a second conductor sheet 40 that has a second signal-feeding contact 421 adapted to contact electrically the second electrical contact 532 on the circuit board 53 when the substrate 2 is mounted in the housing 52.

Figure 6:
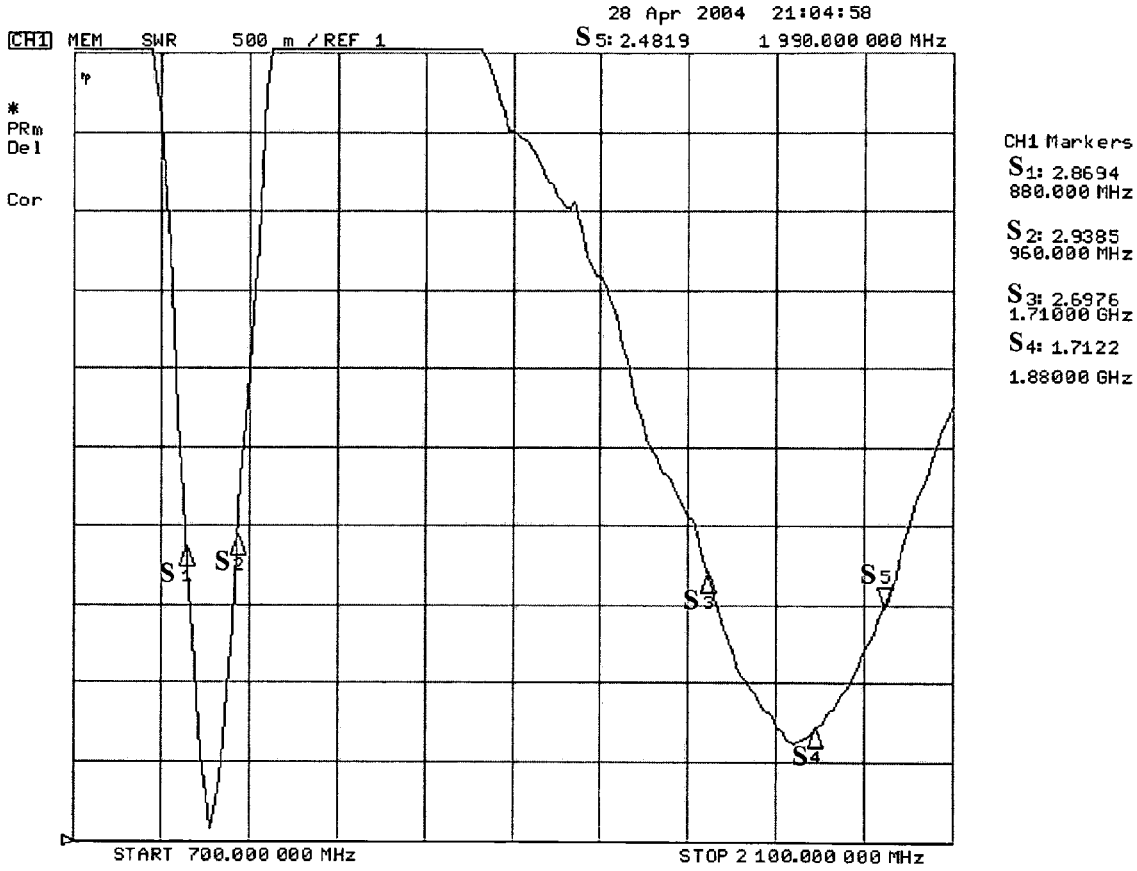
FIG. 6 shows a VSWR chart of the first preferred embodiment.

FIG. 6 shows the measured voltage standing wave ratio (VSWR) for the multi-frequency antenna module 3 of the first preferred embodiment of the present invention. In the chart, standing wave ratios between points S1 and S2 (within a range from 880 MHz to 960 MHz) are close to or less than 2.9, and standing wave ratios between points S3 and S5 (within a range from 1710 MHz to 1990 MHz) are close to or less than 2.7. The resultant bandwidths are wide enough for the 900 MHz frequency band and the 1800 MHz frequency band.

Figure 4:
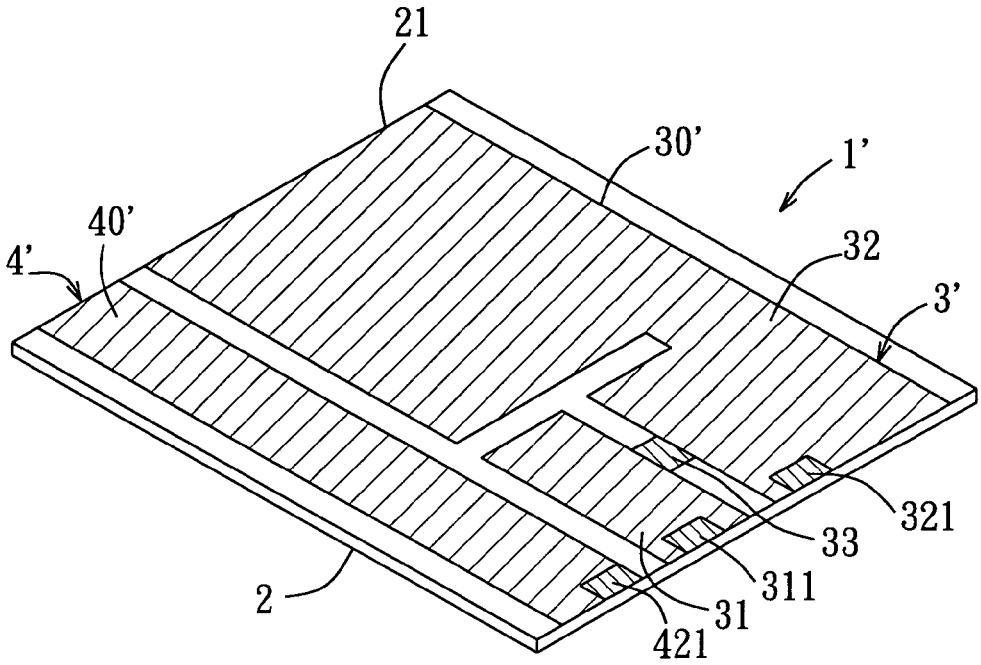
FIG. 4 is a perspective view showing the second preferred embodiment of a multi-frequency antenna module for an electronic apparatus according to the present invention.

FIG. 4 illustrates the second preferred embodiment of a multi-frequency antenna module 1' for an electronic apparatus according to this invention, which is a modification of the first preferred embodiment. In this embodiment, the first conductor sheet 30' is divided into first and second portions 31, 32, and is provided with an impedance matching member 33 that interconnects the first and second portions 31, 32 for enhancing transmission power and for increasing transmission bandwidth. In this embodiment, the first portion 31 is provided with the first signal-feeding contact 311. The second portion 32 is substantially C-shaped and is provided with the grounding contact 321.

Figure 7:
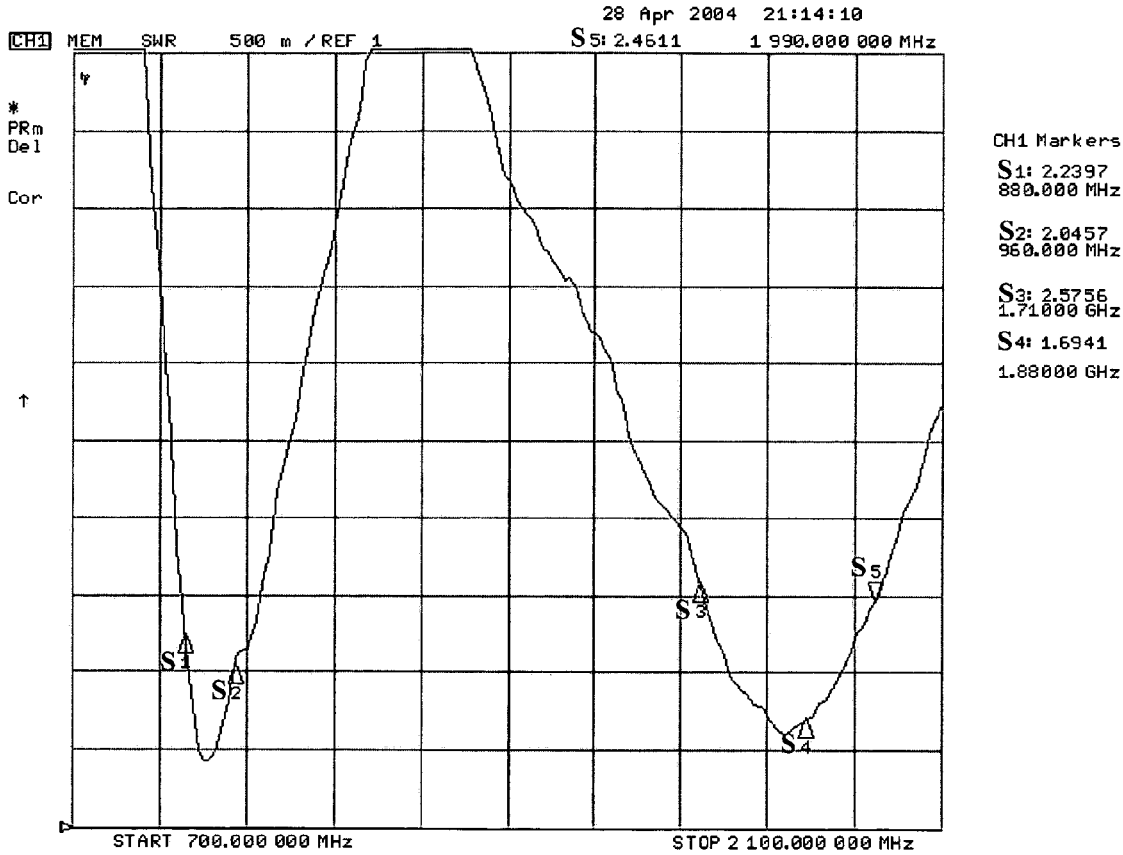
FIG. 7 shows a VSWR chart of the second preferred embodiment.
Figure 8:
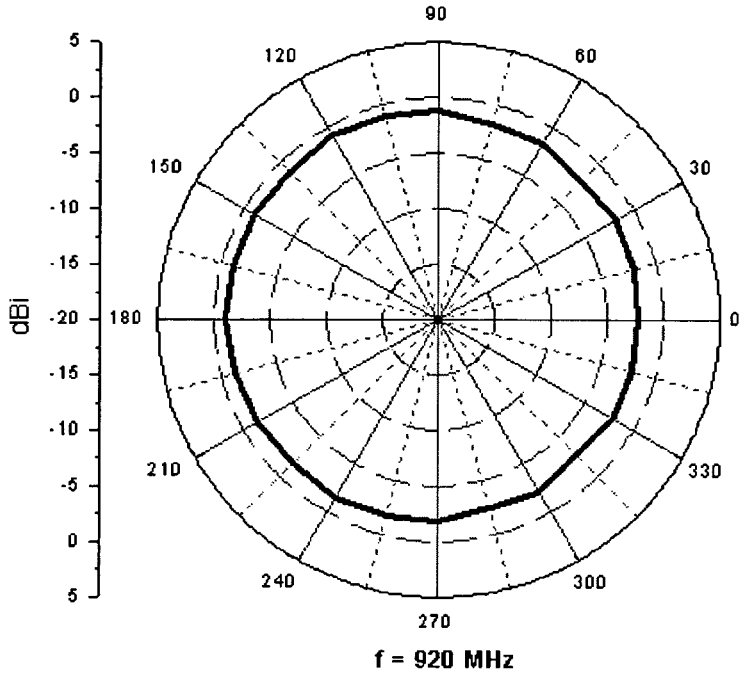
FIG. 8 shows a gain chart of the second preferred embodiment in a horizontal plane at 920 MHz.
Figure 9:
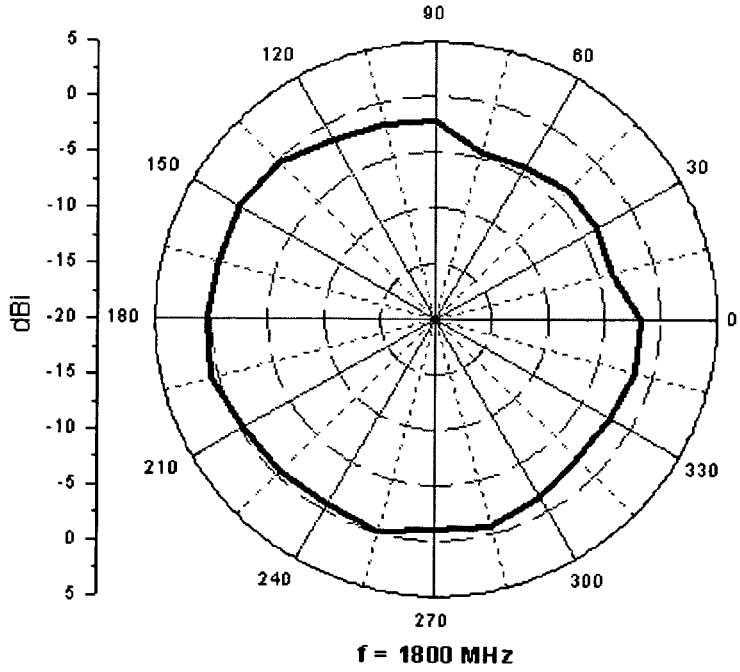
FIG. 9 shows a gain chart of the second preferred embodiment in a horizontal plane at 1800 MHz.

FIG. 7 shows the measured voltage standing wave ratio (VSWR) for the multi-frequency antenna module 3' of the second preferred embodiment of the present invention. In the chart, standing wave ratios between points S1 and S2 (within a range from 880 MHz to 960 MHz) are close to or less than 2.2, and standing wave ratios between points S3 and S5 (within a range from 1710 MHz to 1990 MHz) are close to or less than 2.6. The resultant bandwidths are wide enough for the 900 MHz frequency band and the 1800 MHz frequency band. FIGS. 8 and 9 illustrate measured performances of the multi-frequency antenna module 3' of the second preferred embodiment in a horizontal plane at 920 MHz and 1800 MHz, respectively.

Figure 5:
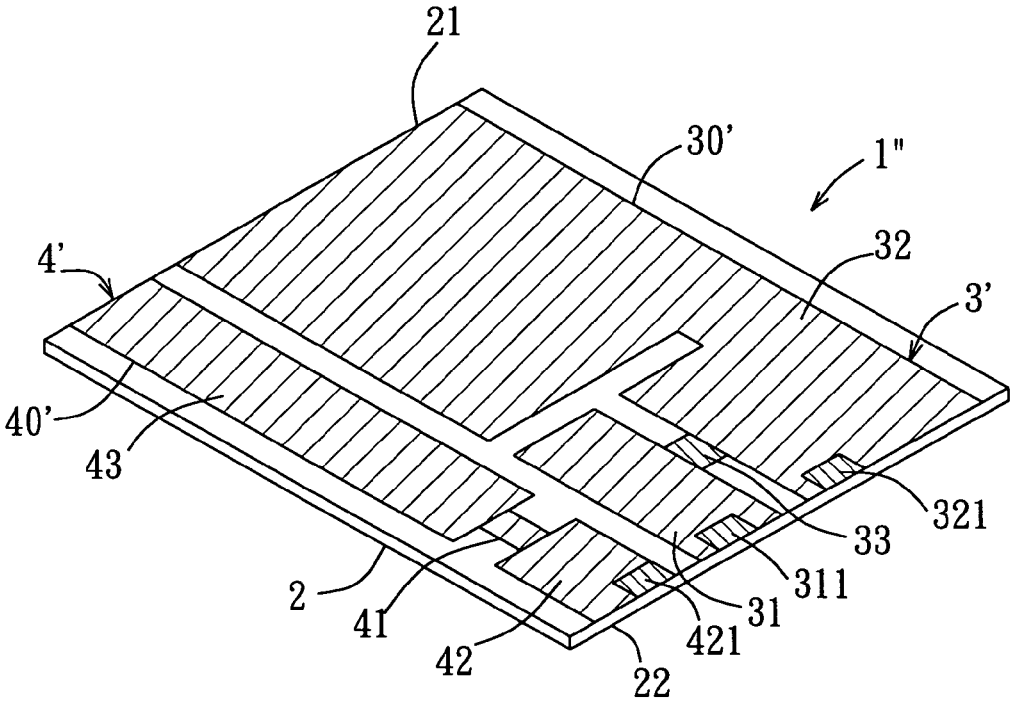
FIG. 5 is a perspective view showing the third preferred embodiment of a multi-frequency antenna module for an electronic apparatus according to the present invention.

FIG. 5 illustrates the third preferred embodiment of a multi-frequency antenna module 1" for an electronic apparatus according to this invention, which is a modification of the second preferred embodiment. In this embodiment, the second conductor sheet 40' is divided into first and second portions 42, 43, and is provided with an impedance matching member 41 that interconnects the first and second portions 42, 43 for enhancing transmission power and for increasing transmission bandwidth.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

We claim:

1. A multi-frequency antenna module for an electronic apparatus, the electronic apparatus including a housing, and a circuit board disposed in the housing and provided with first, second and third electrical contacts thereon, said multi-frequency antenna module comprising:

a dielectric substrate adapted to be mounted in the housing and having a mounting surface;

a first radiating element disposed on said mounting surface of said substrate and including a first conductor sheet that has a first signal-feeding contact adapted to contact electrically the first electrical contact on the circuit board when said substrate is mounted in the housing, and a grounding contact adapted to contact electrically the third electrical contact on the circuit board when said substrate is mounted in the housing; and a second radiating element disposed on said mounting surface of said substrate, spaced apart from said first radiating element, and including a second conductor sheet that has a second signal-feeding contact adapted to contact electrically the second electrical contact on the circuit board when said substrate is mounted in the housing.

2. The multi-frequency antenna module as claimed in claim 1, wherein said substrate is a flexible printed circuit board.

3. The multi-frequency antenna module as claimed in claim 1, wherein said first conductor sheet of said first radiating element is substantially C-shaped.

4. The multi-frequency antenna module as claimed in claim 1, wherein said first conductor sheet of said first radiating element is divided into first and second portions and is provided with an impedance matching member that interconnects said first and second portions, said first portion being provided with said first signal-feeding contact, said second portion being provided with said grounding contact.

5. The multi-frequency antenna module as claimed in claim 4, wherein said second portion of said first conductor sheet is substantially C-shaped.

6. The multi-frequency antenna module as claimed in claim 1, wherein said second conductor sheet of said second radiating element is divided into first and second portions and is provided with an impedance matching member that interconnects said first and second portions, said first portion being provided with said second signal-feeding contact.

7. The multi-frequency antenna module as claimed in claim 1, wherein said first radiating element is capable of receiving and transmitting signals in a first frequency band, and said second radiating element is capable of receiving and transmitting signals in a second frequency band different from the first frequency band.

8. The multi-frequency antenna module as claimed in claim 7, wherein the first frequency band is lower than the second frequency band.

9. The multi-frequency antenna module as claimed in claim 7, wherein the first frequency band includes a GSM frequency band, and the second frequency band includes a DCS/PCS frequency band.

10. An antenna module for an electronic apparatus, the electronic apparatus including a housing, and a circuit board disposed in the housing and provided with first and second electrical contacts thereon, said antenna module comprising:

a dielectric substrate adapted to be mounted in the housing and having a mounting surface; and a radiating element disposed on said mounting surface of said substrate and including a conductor sheet that has a signal-feeding contact adapted to contact electrically the first electrical contact on the circuit board when said substrate is mounted in the housing, and a grounding contact adapted to contact electrically the second electrical contact on the circuit board when said substrate is mounted in the housing.

11. The antenna module as claimed in claim 10, wherein said substrate is a flexible printed circuit board.

12. The antenna module as claimed in claim 10, wherein said conductor sheet of said radiating element is divided into first and second portions and is provided with an impedance matching member that interconnects said first and second portions, said first portion being provided with said signal-feeding contact, said second portion being provided with said grounding contact.

* * * * *